United States Patent [19]

Davis, Jr.

[11] 4,316,410

[45] Feb. 23, 1982

[54] COMPACT CAN CRUSHER

[76] Inventor: Charles M. Davis, Jr., 23 The Point, Coronado, Calif. 92118

[21] Appl. No.: 164,044

[22] Filed: Jun. 30, 1980

Related U.S. Application Data

[63] Continuation-in-part of Ser. No. 95,637, Nov. 19, 1979, abandoned.

[51] Int. Cl.[3] ..... B30B 15/14; B30B 9/32

[52] U.S. Cl. ..... 100/48; 100/209; 100/215; 100/233; 100/268; 100/295; 100/902; 241/99; 241/262

[58] Field of Search ..... 100/209, 233, DIG. 2, 100/48, 52, 215, 295, 265, 268; 241/99, 262–269; 99/581, 582

[56] References Cited

U.S. PATENT DOCUMENTS

| | | | |
|---|---|---|---|
| 2,619,150 | 11/1952 | Smith | 100/DIG. 2 |
| 2,920,554 | 1/1960 | Bunke | 100/DIG. 2 |
| 2,949,078 | 8/1960 | Reed | 100/DIG. 2 |
| 3,036,517 | 5/1962 | Malarsky | 100/DIG. 2 |
| 3,138,090 | 6/1964 | Moorhead | 100/DIG. 2 |
| 3,772,985 | 11/1973 | Girten | 100/DIG. 2 |
| 4,119,024 | 10/1978 | White | 100/DIG. 2 |

FOREIGN PATENT DOCUMENTS

| | | | |
|---|---|---|---|
| 2011302 | 7/1979 | United Kingdom | 100/233 |

*Primary Examiner*—Billy J. Wilhite
*Attorney, Agent, or Firm*—Brown & Martin

[57] ABSTRACT

A compact can crusher in which used beverage cans and the like are dropped into a chute and are crushed flat between an oscillating crusher plate and a wall of the chute, the crushed cans being dropped through an open lower end of the chute. A drive motor is coupled to the crusher plate to apply maximum thrust at opposite ends of the oscillating stroke, so that cans are effectively flattened to a minimum thickness. In one form spring stored energy adds to the initial crushing action when the most pressure is needed, and provision is made to prevent cans from jamming in the chute and to prevent the mechanism from being jammed by articles which are not readily crushed.

14 Claims, 10 Drawing Figures

COMPACT CAN CRUSHER

This application is a continuation-in-part of my copending application Ser. No. 095,637, filed Nov. 19, 1979 and entitled "Compact Can Crusher", now abandoned.

BACKGROUND OF THE INVENTION

In the recycling of beverage cans and the like, particularly aluminum cans, very large quantities of cans are collected and must be reduced to a minimum volume for economical shipment and storage. For a commercial type operation in which hundreds or thousands of pounds of cans are processed daily, can crushers such as described in my prior U.S. Pat. Nos. 3,814,009 and 4,059,050 have been successfully used. In these machines cans are fed between contacting rotating wheels, which crush large numbers of cans rapidly and throw them into a receptacle. However, the apparatus is powerful, noisy and suited only to a large scale operation.

For small scale use, domestic type trash compactors have been developed. These are designed to compact a variety of materials and usually have a linear type crushing action, which does not have the power to crush cans completely flat. In any event, this type of compactor is not intended nor suited for crushing only cans for subsequent recycling.

Since recycling is likely to continue and even increase in scope, there is a need for a can crusher which will handle a small but substantial number of cans, such as in a bar or restaurant operation. Such a unit must necessarily be compact and reasonably quiet in operation and require a minimum of maintenance.

SUMMARY OF THE INVENTION

The can crusher described herein is a compact cabinet type unit which can be installed in or under a bar or counter, or positioned in any convenient location in a minimum of space. Cans are placed in a hopper in the top of the unit and fall into a chute, in which a crusher plate oscillates from side to side. Cans are crushed between the crusher plate and at least one adjacent wall of the chute, the flattened cans falling from the open lower end of the chute into a suitable receptacle.

The crusher plate is dirven by a motor through a double crank and connecting rod mechanism, which is aligned so that maximum power is applied at both limits of travel of the plate. This ensures that cans will be crushed as flat as possible at the end of the stroke. In one configuration, springs are compressed during one stroke and the stored energy adds to the motor power at the start of the return stroke. In other configurations, provision is made for preventing the mechanism from jamming on an article which cannot be crushed sufficiently to allow the machine to complete a stroke.

The mechanism is contained in a simple frame structure, which can be enclosed as a free standing unit or built into other structure. In operation the machine is reasonably quiet and would not be disturbing in a bar or restaurant environment.

The primary object of this invention, therefore, is to provide a new and improved compact can crusher.

Another object of this invention is to provide a can crusher which can be installed in or under a bar, counter, or similar structure.

Another object of this invention is to provide a can crusher which crushes cans on one or both sides of an oscillating crusher plate, with maximum flattening power occuring at the end of each stroke.

A further object of this invention is to provide a compact can crusher which is simple to construct and operate and requires a minimum of maintenance.

Other objects and advantages will be apparent in the following detailed description, taken in conjunction with the accompanying drawing, in which.

DESCRIPTION OF THE PREFERRED EMBODIMENTS

Figure 1:
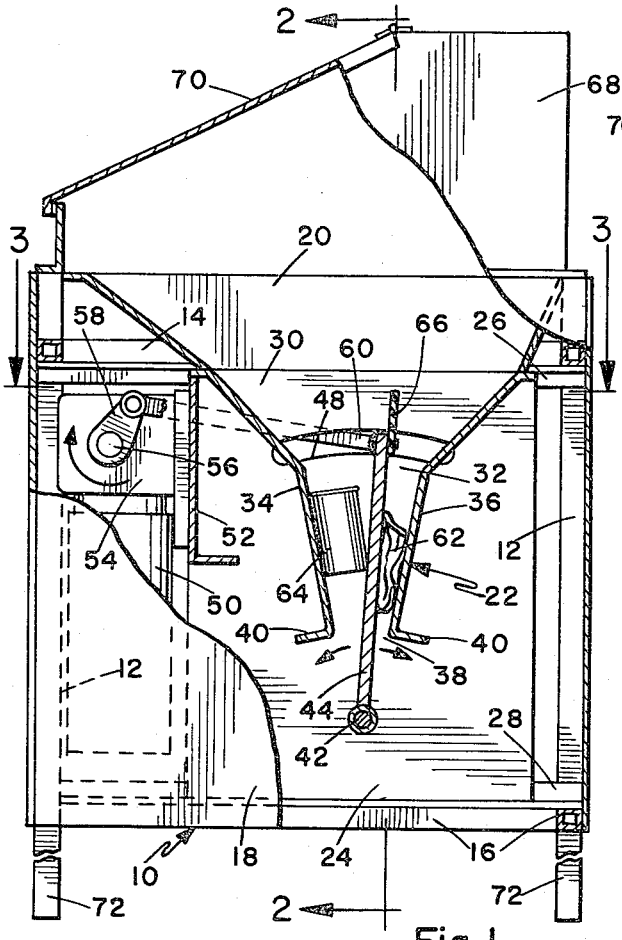
FIG. 1 is a side elevation view of the complete can crusher, with portions cut away.
Figure 2:
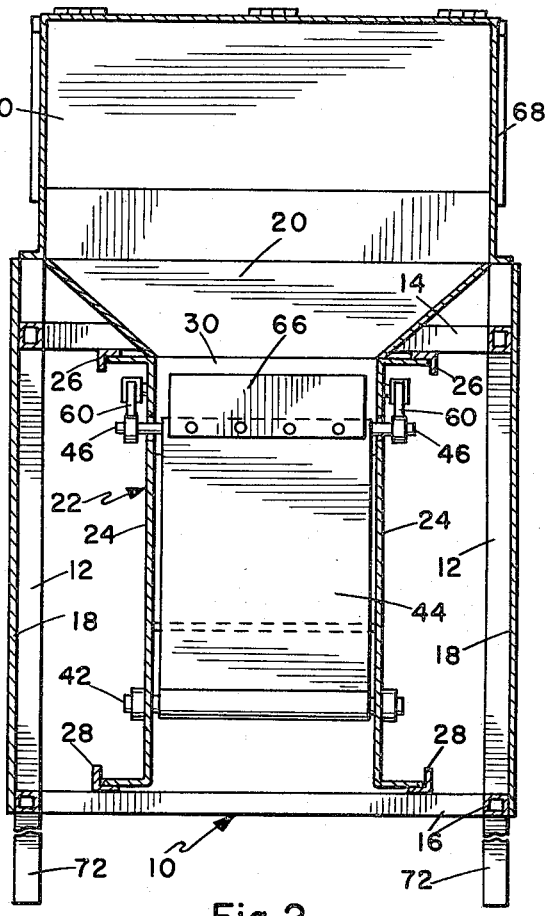
FIG. 2 is a sectional view taken on line 2—2 of FIG. 1.
Figure 3:
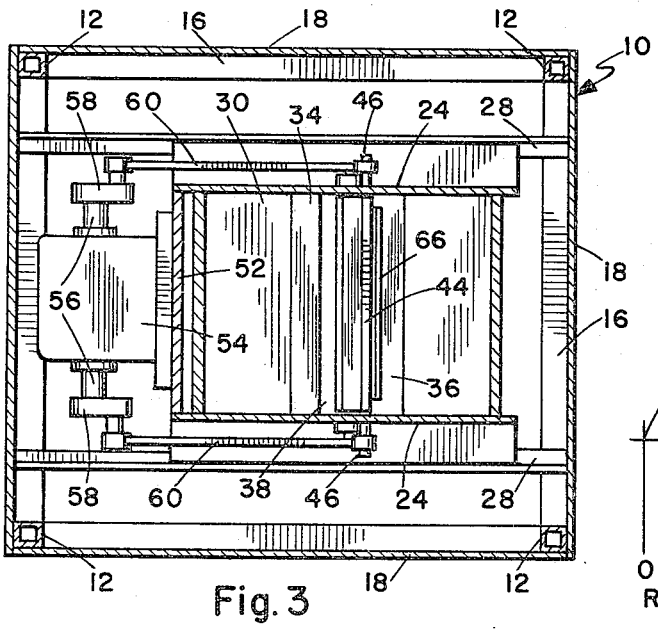
FIG. 3 is a sectional view taken on line 3—3 of FIG. 1.

The can crusher illustrated in FIGS. 1–3 is constructed with a rigid rectangular box frame 10 having upright corner posts 12, spaced by upper cross members 14 and lower cross members 16 on all four sides. The actual details of construction may vary, the arrangement shown being a simple basic frame, which may be enclosed by side panels 18 if the unit is to be free standing.

In the upper portion of frame 10 is a hopper 20 leading into a downwardly converging chute 22. The chute is enclosed between a pair of vertical side plates 24, which are fixed to upper rails 26 extending between upper cross members 14 and lower rails 28 extending between lower cross members 16. The chute 22 has a wide upper portion 30 converging to an entry throat 32 between a front wall 34 and a rear wall 36. Front and rear walls 34 and 36 converge at equal angles to an open lower end 38 and are reinforced by outwardly extending lower flanges 40.

Below the open lower end and centered between the front and rear walls is a hinge pin 42, extending perpendicularly between and journaled in side plates 24. Pivotally mounted on hinge pin 42 is a rigid crusher plate 44, which extends upwardly between the front and rear walls. The position of the hinge pin 42 and the convergence angle of the front and rear walls 34 and 36 are related, so that at the end of each stroke the crusher plate 44 is substantially flat against each of the front and rear walls. In actual construction a minimum gap would be incorporated to allow for the thickness of a flattened can and avoid binding or undue strain on the mechanism.

Fixed on the upper end of the crusher plate 44 are drive pins 46 projecting outwardly through slots 48 in the side plates 24. In the front portion of the machine is a drive motor 50 mounted on a suitable bracket 52. The drive motor has a reduction gear box 54 with a drive shaft 56 projecting from both sides. On each end of drive shaft 56 is a crank 58, which is pivotally coupled by a connecting rod 60 to the drive pin 46 on that side. The crusher plate 44 is thus oscillated back and forth by rotation of cranks 58.

Figure 4:
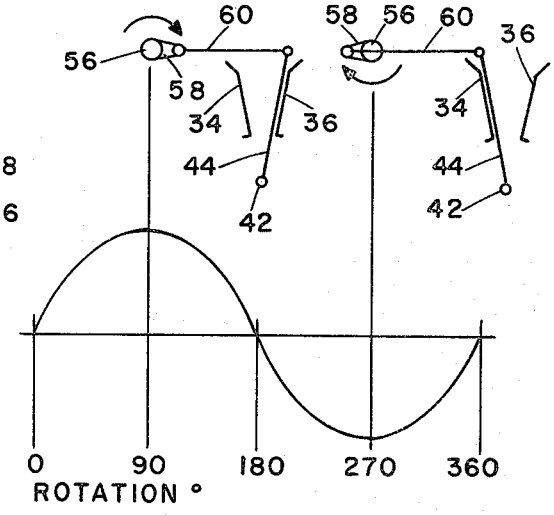
FIG. 4 is a diagram showing the application of crushing power through a complete cycle of the machine.

To achieve maximum crushing power the drive shaft 56 is positioned to be horizontally parallel to the drive pins 46 at each end of the crusher plate travel. As indicated in FIG. 4, this will apply maximum crushing power to the crusher plate at the ends of the stroke. Starting from a vertically upward position of the cranks 58, the power will increase to a maximum with the rearward thrust of the cranks at the 90 degree position, when the crusher plate 44 is against rear wall 36. In this position the bellcranks are almost in a straight out lock position, in which the back pressure or resistance to rotation of the drive shaft is minimal. On the return stroke the power will decrease to the vertically downward position of the cranks, when the crusher plate is against front wall 34.

This alignment makes the unit particularly efficient in reducing cans to a minimum size, since it is the last small amount of crushing which requires the most power. At this stage the crushed can has many folds and wrinkles and considerable pressure is necessary to completely crush all of those deformities. It is for this reason that the linear motion and other small compactor actions will not effectively flatten cans to their smallest volume.

In FIG. 1, a partially crushed can 62 is shown between crusher plate 44 and rear wall 36, while another can 64 has fallen between the crusher plate and front wall 34 to be flattened on the return stroke. Cans loaded into hopper 20 can thus fall on either side of the crusher plate and be flattened in either direction. To prevent cans from bridging the crusher plate or hanging up in the chute, a flexible stirring blade 66 is secured to and extends upwardly from the upper end of the crusher plate.

If the unit is to be free standing or normally open above the hopper, a suitable hood enclosure 68 may be attached to the top of frame 10 with a hinged door 70 for access to the hopper. Alternatively, a simple lid could be installed over the hopper, depending on the particular installation.

Flattened cans are dropped from the open lower end 38 of the chute and may be collected in a suitable receptacle. For convenience the corner posts 12 may be extended downwardly to provide legs 72, so that a receptacle can be placed under the unit.

Figure 5:
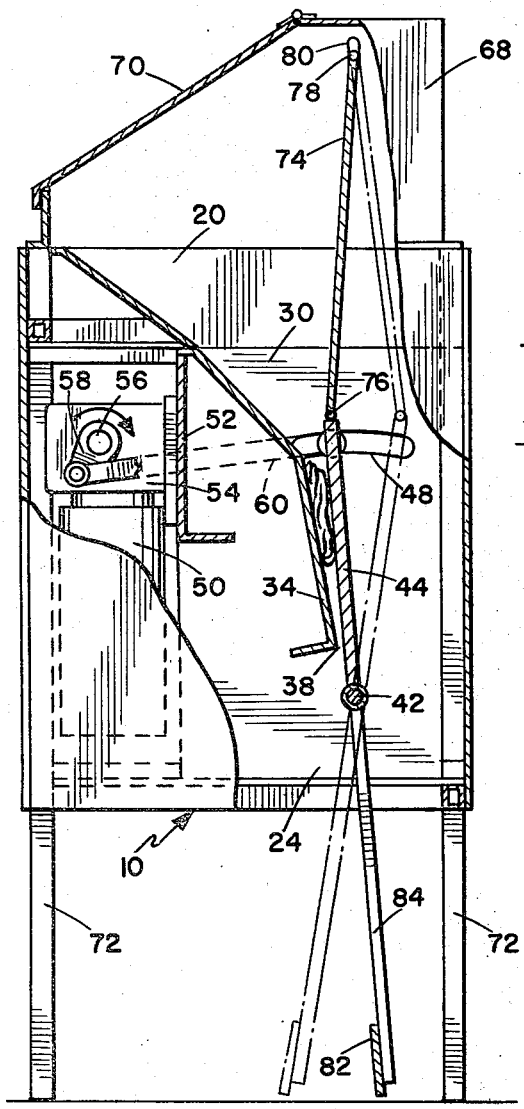
FIG. 5 is a view similar to FIG. 1, showing an alternative one sided crusher mechanism.

A more compact structure is illustrated in FIG. 5, in which the crushing operation is single action against only one wall of the chute. The basic frame structure, drive mechanism and front portion of the chute are all as described for FIGS. 1–3, and the same numerals are used for the common parts.

In this configuration the rear portion of the chute is omitted and the crusher plate 44 forms the movable rear wall of the chute, so that cans are crushed against the front wall 34 only. To prevent cans from falling behind the crusher plate 44, a baffle plate 74 is coupled by a hinge 76 to the upper edge of the crusher plate and extends upwardly into the top portion of hood 68. The upper end of baffle plate 74 is retained by pins 78 riding in slots 80 in the hood, to accommodate the motion of the baffle plate as the crusher plate 44 is oscillated. The baffle plate is, in effect, a movable rear wall of the hopper.

To prevent crushed cans from building up under the unit and possibly jamming the mechanism, a sweeper blade 82 is suspended on support rods 84 below and opposed to the crusher plate 44. The sweeper blade 82 is closely spaced from the floor or ground and swings with the crusher plate to clear the area immediately below the lower end 38 of the chute, as indicated in the two position in FIG. 5. The sweeper blade is applicable to any of the crusher configurations described herein.

Figure 6:
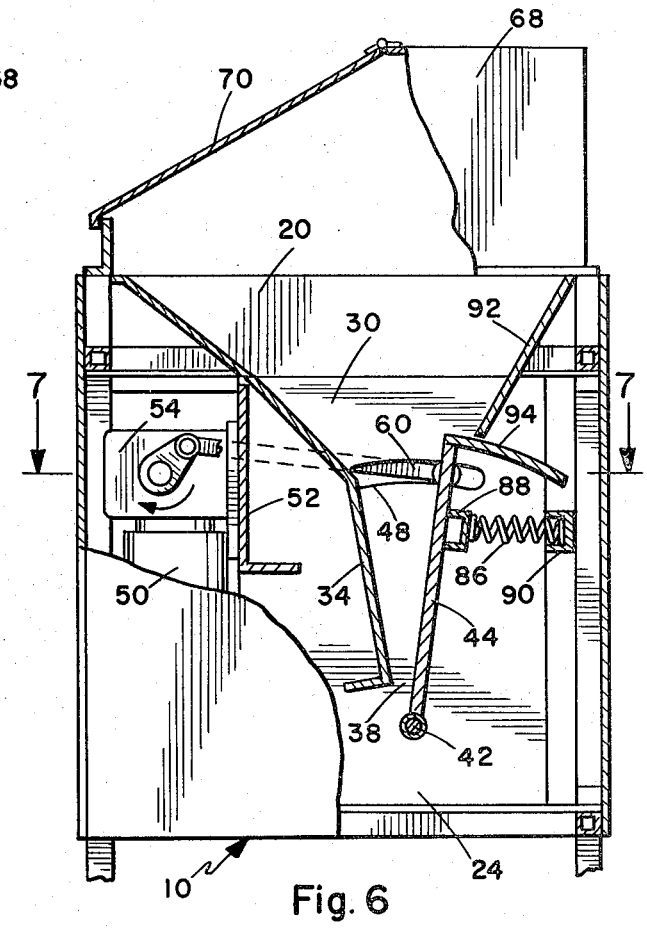
FIG. 6 is a further similar view showing a spring boosted mechanism.
Figure 7:
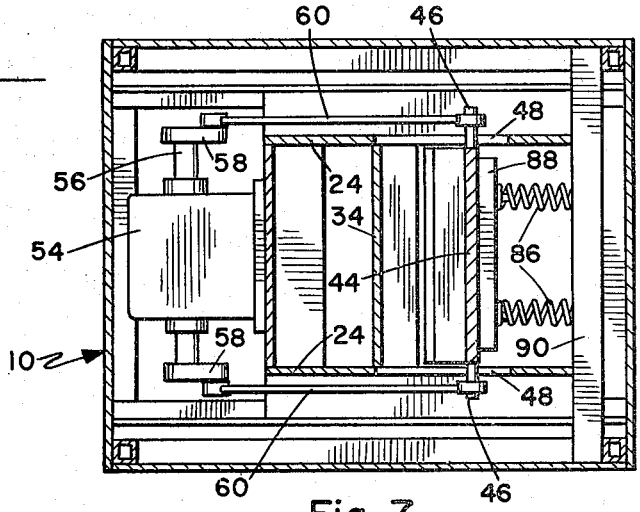
FIG. 7 is a sectional view taken on line 7—7 of FIG. 6.

The configuration illustrated in FIGS. 6 and 7 is a single action crusher similar to FIG. 5, but has a spring assisted action which makes it possible to use a smaller drive motor. Again the pertinent elements of the structure are numbered to correspond with FIGS. 1–3.

The differences include a spring or springs 86 installed between a brace 88 across the rear of the crusher plate 44 and a support beam 90 fixed across the rear of frame 10. Compression type coil springs are illustrated, but any suitable spring arrangement can be used.

In the rearward stroke of the crusher plate 44, with no can being crushed, all the power of the motor 50 is applied to compress springs 86. When the forward stroke begins the stored power in the springs is added to that of the motor, which is also at a peak as indicated in FIG. 4 at the 90 degree position. This combined power occurs at the initial crushing of the can, when maximum power is required to fold and flatten the ends of the can. Thus the power which would otherwise be wasted in the rearward stroke of the crusher plate is stored and added to the forward stroke power, enabling the use of a smaller motor for efficient overall performance.

In this configuration, also, an alternative method of controlling cans is shown. The rear of the hopper has a forwardly and downwardly inclined rear panel 92, which terminates just above the upper end of crusher plate 44. Fixed to the upper end of the crusher plate is a rearwardly extending baffle plate 94, which passes under the rear panel 92 and prevents cans from falling behind the crusher plate.

The unit can thus be constructed to provide single or double action crushing, depending on the volume of cans to be handled and the space available. It has been found that the unit will readily crush full and partially full cans, squeezing out the contents completely. Bottles can also be crushed if desired, either separately or mixed with cans if facilities for subsequent separation are available. With a suitable motor, the unit is quiet in operation and would not be disturbing in the normal environment of a bar or restaurant.

Figure 8:
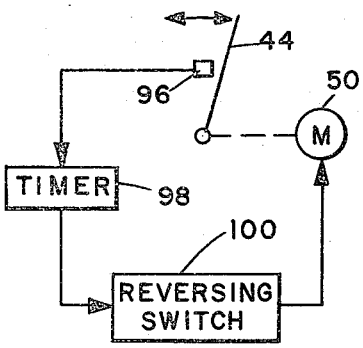
FIG. 8 is a schematic of a jam preventing circuit.

If the unit is used in a continuous operation where constant monitoring is not available, it is desirable to have some means for preventing jamming in the event of a can or other item which will not crush due to the presence of foreign material. A suitable circuit is shown in FIG. 8, in which a detector 96 of any suitable type senses the passing of the crusher plate 44 at each stroke. The detector is connected to a timer 98 set to the normal time interval of each stroke, so that if a stroke takes longer than normal, by a predetermined time allowance, the timer will trigger a reversing switch 100 to reverse motor 50. Thus if a solid object jams the crusher plate, the stroke will be reversed, allowing the object to fall through the unit and avoid jamming or shut down.

Figure 9:
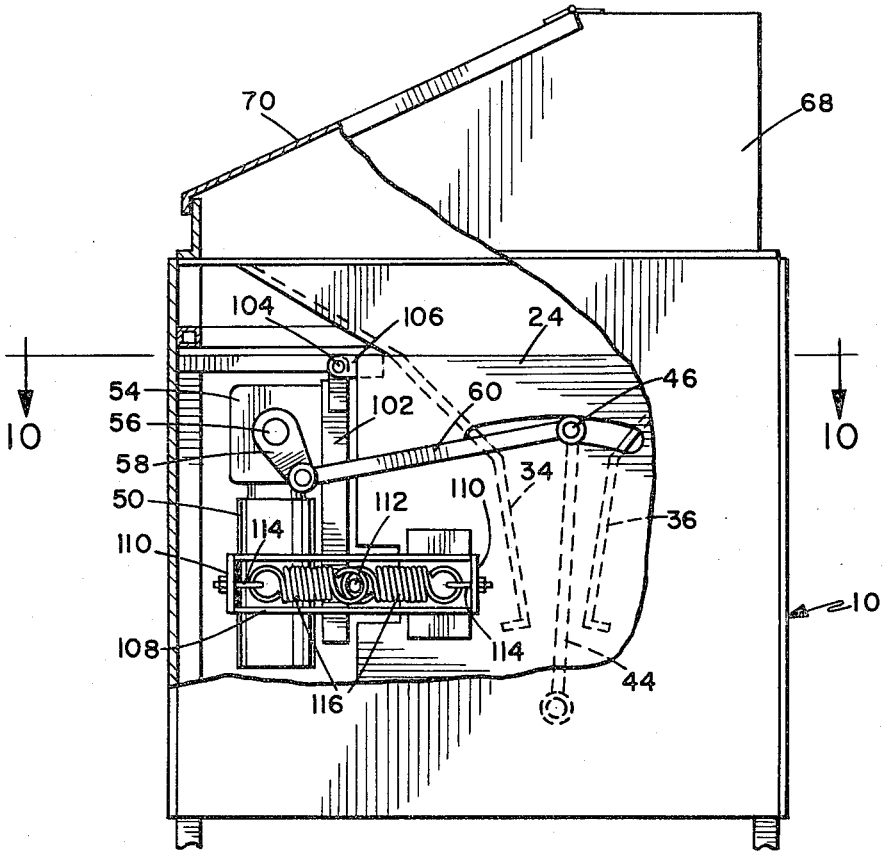
FIG. 9 is a side elevation view, partially cut away, of a machine incorporating a jam preventing spring mounting for the drive mechanism.
Figure 10:
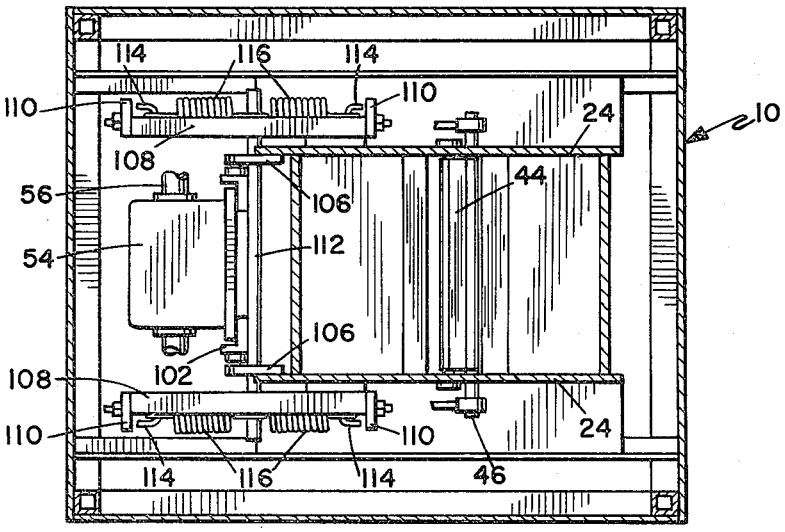
FIG. 10 is a sectional view taken on line 10—10 of FIG. 9.

An alternative means for preventing jamming is illustrated in FIGS. 9 and 10, in which the machine is similar in many respects to that of FIGS. 1–3, all corresponding parts being similarly numbered. The only difference is in the mounting of the drive motor, which is now resilient rather than fixed.

Drive motor 50 with gear box 54 is secured to a mounting bracket 102, which is pivotally suspended on hinge pins 104 in brackets 106 fixed to the side plates 24. The axis of hinge pins 104 is parallel to the axis of drive shaft 56 to accommodate the displacement symmetrically. The drive shaft 56 is coupled by cranks 58 and connecting rods 60 to the crusher plate 44, as described for FIGS. 1–3, this drive coupling being cut away in FIG. 10 for clarity.

Fixed to the outside of each side plate 24 near the lower end of mounting bracket 102 is an elongated box frame 108 having opposite end plates 110. Secured across the mounting bracket 102 is a tie rod 112, the ends of which project outwardly through box frames 108. In each end plate 110 is an inwardly projecting hook 114, and between each hook and tie rod 112 is a tension spring 116. The opposed springs are tensioned sufficiently to hold the mounting bracket 102 centered in the normal driving position, as in FIG. 9, and are strong enough to resist any undue displacement in normal operation of the machine. That is, normal crushing action of cans can take plate without the drive mechanism shifting against the springs.

If the crusher receives an article which cannot be crushed sufficiently to allow the mechanism to complete a stroke, the overload will cause the mounting bracket to pivot and overcome springs 116. This will permit the mechanism to complete a stroke and reverse, allowing the incompletely crushed article to drop through. Jam proof action is thus provided by simple mechanical means.

Having described my invention, I now claim:

1. A compact can crusher, comprising:

a rigid supporting frame;

a can receiving chute mounted in said frame and having an upper entry throat and an open lower end;

said chute having spaced upright side plates and downwardly converging walls extending perpendicularly between the side plates, the walls including a fixed front wall;

a crusher plate pivotally mounted in said frame, said crusher plate having a hinge pin journalled in said side plates below the open lower end of the chute;

said crusher plate extending upwardly through the chute to swing into crushing engagement with said front wall and having drive pins extending from opposite sides of the upper end thereof;

a drive motor mounted in said frame with a drive shaft extending on both sides thereof;

a crank on each end of said drive shaft, and a connecting rod coupling each crank to one of said drive pins to oscillate said crusher plate toward and away from said front wall.

2. A compact can crusher according to claim 1, wherein said drive shaft is substantially parallel horizontally to said drive pins at the limits of travel of the crusher plate, whereby maximum thrust is applied at the ends of each oscillating stroke.

3. A compact can crusher according to claim 1, and including a flexible can stirring blade secured to and projecting upwardly from the upper end of said crusher plate.

4. A compact can crusher according to claim 1, wherein said crusher plate forms a rear wall of the chute.

5. A compact can crusher according to claim 4, wherein said chute has a can receiving hopper at the upper end thereof, said crusher plate having a baffle plate attached to the upper end thereof and closing the rear portion of the hopper behind the crusher plate.

6. A compact can crusher according to claim 5, wherein said baffle plate is pivotally attached to said crusher plate, the upper end of said baffle plate being movably attached to an upper portion of the hopper.

7. A compact can crusher according to claim 5, wherein said hopper has a downwardly inclined rear panel, said baffle plate being fixed to and extending rearwardly from the crusher plate immediately below said rear panel.

8. A compact can crusher according to claim 4, and including a support member fixed in said frame rearwardly of the crusher plate, and compressible spring means mounted between said crusher plate and said support member.

9. A compact can crusher according to claim 4, and including spring means coupled to said crusher plate for loading by the rearward stroke of the crusher plate and adding the spring loaded power to the forward stroke of the crusher plate.

10. A compact can crusher according to claim 1, and including a sweeper blade suspended below and movable with said crusher plate, said sweeper blade being closely spaced above a crushed can collecting surface below the open lower end of the chute.

11. A compact can crusher according to claim 1, and including detecting means for detecting the movement of the crusher plate through each stroke, timing means connected to said detector to time each stroke, and reversing means coupled to said drive means and being responsive to said timer to reverse the drive means when the time for a particular stroke exceeds the normal time due to obstruction of the crusher plate.

12. A compact can crusher according to claim 1, and including spring means holding said drive means in a normal driving position, while allowing displacement of the drive means when motion of the crusher plate is obstructed.

13. A compact can crusher according to claim 1, and including a mounting bracket pivotally supported in said frame, said drive motor being mounted on said mounting bracket, and spring means connecting between the mounting bracket and frame to hold the mounting bracket in a normal drive position of the drive motor.

14. A compact can crusher according to claim 13, wherein said mounting bracket is pivotally supported between said side plates and has a tie rod projecting from opposite sides thereof, said spring means including opposed springs each connected at one end to said tie rod and at the other end to said side plates, holding the tie rod centered therebetween.

* * * * *